US012654285B2

(12) United States Patent
Morancais et al.

(10) Patent No.: US 12,654,285 B2
(45) Date of Patent: Jun. 16, 2026

(54) DEVICE AND METHOD FOR TREATING A METAL PART

(71) Applicant: SAFRAN AIRCRAFT ENGINES, Paris (FR)

(72) Inventors: Amélie Morancais, Gif-sur-Yvette (FR); Laurianne Besson, Ballainvilliers (FR); Nathalie Dang, Maisons Alfort (FR); Christian Sok, Vincennes (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 1495 days.

(21) Appl. No.: 16/473,539

(22) PCT Filed: Dec. 22, 2017

(86) PCT No.: PCT/FR2017/053837

§ 371 (c)(1),
(2) Date: Jun. 25, 2019

(87) PCT Pub. No.: WO2018/122523

PCT Pub. Date: Jun. 5, 2018

(65) Prior Publication Data

US 2020/0122296 A1 Apr. 23, 2020

(30) Foreign Application Priority Data

Dec. 26, 2016 (FR) ..... 1663372

(51) Int. Cl.
*B24C 1/08* (2006.01)
*B24C 1/10* (2006.01)
(Continued)

(52) U.S. Cl.
CPC ..... *B24C 1/08* (2013.01); *B24C 1/10* (2013.01); *B24C 5/005* (2013.01); *B24C 9/003* (2013.01); *C21D 7/06* (2013.01)

(58) Field of Classification Search
CPC ..... B24C 5/005; B24C 9/003; B24C 1/10; B24C 1/08; B24C 1/083; B24C 11/00
(Continued)

(56) References Cited

U.S. PATENT DOCUMENTS 6,343,495 B1 2/2002 Cheppe et al.
6,431,958 B1 8/2002 Bru-Magniez et al.
(Continued)

FOREIGN PATENT DOCUMENTS

DE 10 2006 008210 A1 8/2007
EP 0 362 449 A1 4/1990
(Continued)

OTHER PUBLICATIONS

Tungsten Nation, What is Mohs Scale of Mineral Hardness, 2014, p. 1 (Year: 2014).*
(Continued)

*Primary Examiner* — Joel D Crandall
(74) *Attorney, Agent, or Firm* — CUSHMAN PARTNERS LLC

(57) ABSTRACT

A device for treating a metal part having an outer surface, includes a chamber, a vibration module including: a generator for generating an electric signal at ultrasonic frequency, a converter for converting the electric signal into a mechanical vibration, the mechanical vibration being transmitted to a sonotrode, the sonotrode positioned in the chamber facing the outer surface of the metal part, projectiles positioned inside the chamber for impacting against the outer surface of the metal part, the projectiles being moved by the vibration of the sonotrode and including a plurality of abrasive media which, when moved by the vibration of the sonotrode, introduce residual compressive stresses and improve the surface condition of the metal part.

9 Claims, 2 Drawing Sheets

(51) Int. Cl.
*B24C 5/00* (2006.01)
*B24C 9/00* (2006.01)
*C21D 7/06* (2006.01)

(58) Field of Classification Search
USPC ..... 451/87, 38, 39, 75
See application file for complete search history.

(56) References Cited

U.S. PATENT DOCUMENTS

| | | | | |
|---|---|---|---|---|
| 8,550,873 | B2 * | 10/2013 | Vijay | B05B 3/06 451/3 |
| 2006/0021410 | A1 * | 2/2006 | Cheppe | B24C 5/005 72/53 |
| 2008/0282756 | A1 * | 11/2008 | Cheppe | B24C 5/005 72/53 |
| 2009/0044406 | A1 | 2/2009 | Dautl et al. | |
| 2009/0095042 | A1 | 4/2009 | Hoffman-Ivy et al. | |
| 2010/0255758 | A1 * | 10/2010 | Lorenzen | B24B 33/082 451/340 |
| 2012/0294756 | A1 | 11/2012 | Yamaguchi et al. | |
| 2013/0125600 | A1 | 5/2013 | Kobayashi et al. | |
| 2015/0013412 | A1 | 1/2015 | Haverty et al. | |
| 2015/0239020 | A1 * | 8/2015 | Ponomarev | B08B 7/028 134/1 |

FOREIGN PATENT DOCUMENTS

| | | | |
|---|---|---|---|
| EP | 1 038 977 | A1 | 9/2000 |
| EP | 1 207 014 | A1 | 5/2002 |
| FR | 2 714 629 | A1 | 7/1995 |
| FR | 2 815 280 | A1 | 4/2002 |
| FR | 2 815 281 | A1 | 4/2002 |
| FR | 2 873 609 | A1 | 2/2006 |
| FR | 2 979 276 | A1 | 3/2013 |
| JP | 2001-018126 | A | 2/2001 |
| JP | 2002-506741 | A | 3/2002 |
| JP | 2012-055976 | A | 3/2012 |
| WO | WO 2009/067978 | A1 | 6/2009 |

OTHER PUBLICATIONS

QR International Search Report as issued in International Patent Application No. PCT/FR2017/053837, dated Apr. 4, 2018.
Examiner's Decision of Rejection as issued in Japanese Patent Application No. 2019-534868, dated Jun. 7, 2022.

* cited by examiner

DEVICE AND METHOD FOR TREATING A METAL PART

CROSS REFERENCE TO RELATED APPLICATIONS

This application is the U.S. National Stage of PCT/FR2017/053837, filed Dec. 22, 2017, which in turn claims priority to French Patent Application No. 1663372 filed Dec. 26, 2016, the entire contents of all Applications are incorporated herein by reference in their entireties.

TECHNICAL FIELD OF THE INVENTION

The invention relates to the treatment of metal parts and more specifically a device making it possible to reduce the treatment time of said metal parts.

TECHNOLOGICAL BACKGROUND OF THE INVENTION

In order to improve the mechanical performances of certain metal parts, and in particular their surface properties, it is known to use mechanical surface treatment techniques such as shot blasting and/or tribofinishing which make it possible, respectively, to modify the structure and the surface condition of said metal parts.

Conventional or ultrasonic shot blasting introduces residual compressive stresses in order to improve the mechanical strength of metal parts. More specifically, it involves projecting at high speed beads made of steel, glass or ceramic onto the surface of a metal part in order that said metal part undergoes a deformation over a small thickness. The patent applications FR no 2873609, FR no 2815280, FR no 2815281 thus describe methods for shot blasting metal parts.

Tribofinishing makes it possible to complete the surface finishing of metal parts by polishing, burr removal, smoothing, etc. To do so, the metal parts to treat are immersed in a vibrating vessel containing a mixture of abrasive media and a liquid (water, oil, additives). The friction of the metal parts with the abrasive mixture makes it possible to ensure the polishing, burr removal and rounding down of the angles of said metal parts.

In the majority of cases, these two techniques are used successively in the production line. Thus, the treatment of metal parts is long and requires numerous controls of said metal parts.

GENERAL DESCRIPTION OF THE INVENTION

The invention thus provides a solution making it possible to reduce the number of operations and controls of metal parts and consequently the treatment time of said metal parts.

The invention according to a first aspect relates to a device for treating a metal part having an outer surface, said device comprising:

- an enclosure,
- a vibration module comprising:
  - a generator for generating an electrical signal at ultrasonic frequency,
  - a converter for converting said electrical signal into a mechanical vibration, said mechanical vibration being transmitted to a sonotrode,
  - the sonotrode positioned in the enclosure facing the outer surface of the metal part,
- projectiles placed in the enclosure for impacting the outer surface of the metal part, said projectiles being moved by the vibration of the sonotrode.

Moreover, the projectiles comprise a plurality of abrasive media which, when moved by the vibration of the sonotrode, introduce residual compressive stresses and improve the surface condition of the metal part.

"Abrasive media" is taken to mean an element of variable shape generally comprising a base and a hard abrasive charge that wears out other materials softer than this material.

"Improve the surface condition" is taken to mean polishing, burr removal, snap the angles of the metal part.

The device for treating a metal part according to the invention makes it possible to resolve the aforementioned problems.

Such a device makes it possible to reduce the treatment time of the metal parts while reducing the number of operations and the number of controls.

Indeed, the device of the invention makes it possible, using a single machine, to carry out an operation ensuring both the shot blasting and the finishing of the metal part. More specifically, the device of the invention is similar to ultrasonic shot blasting machines according to the prior art, with the difference that the projectiles that normally comprise beads made of ceramic, glass or steel are replaced by projectiles comprising abrasive media used in conventional tribofinishing techniques. Thus, the abrasive media ensure both the introduction of residual compressive stresses and the improvement of the surface condition of the metal part.

By choosing the optimal projectiles (shape, material, size)/parameters of the electrical signal (frequency, amplitude, emission time) pairing, it is possible to obtain the same result as using two different machines as is the case in the prior art. Indeed, the projectiles/parameters of the electrical signal pairing is chosen such that the projectiles have sufficient speed to introduce residual compressive stresses in the metal part while improving the surface condition of said metal part.

In addition, the use of the device according to the invention makes it possible to reduce the number of controls of metal parts since a single control is necessary after the treatment of the part which further reduces the treatment time of the parts.

Finally, the lightening of the production line makes it possible to reduce the production cost of metal parts.

Apart from the characteristics that have been mentioned in the preceding paragraph, the device according to the first aspect may have one or more complementary characteristics among the following, considered individually or according to all technically possible combinations thereof.

According to a non-limiting embodiment, the projectiles only comprise abrasive media.

According to a non-limiting embodiment, the device comprises a suction system sucking up residues of the metal part and residues of projectiles derived from the impact of said projectiles with each other and of said projectiles on the outer surface of the metal part.

According to a non-limiting embodiment, the device comprises a filter allowing the passage of residues of the metal part and residues of projectiles from the enclosure to the suction system.

According to a non-limiting embodiment, the abrasive media have a thickness comprised in the interval [0.8 mm, 10 mm], According to a non-limiting embodiment, at least one abrasive medium of the plurality of abrasive media comprises a base made of one of the following materials:

plastic,
ceramic,
organic.

According to a non-limiting embodiment, at least one abrasive medium of the plurality of abrasive media comprises an abrasive charge having a hardness comprised in the interval [8 Mohs, 10 Mohs]

According to a non-limiting embodiment, the abrasive charge is constituted of at least one of the following compounds:

corundum,
alumina,
boron nitride,
silicon carbide,
boron carbide,
diamond.

According to a non-limiting embodiment, at least one abrasive medium of the plurality of abrasive media has a shape among the following:

cylindrical,
spherical,
pyramidal,
conical.

According to a non-limiting embodiment, the electrical signal is emitted at an ultrasonic frequency comprised in the interval [15 kHz, 60 kHz].

According to a non-limiting embodiment, the amplitude of the sonotrode is comprised in the interval [10 μm, 300 μm].

According to a second aspect, the invention relates to a method for treating a metal part, comprising the steps of:

- placing projectiles in an enclosure, said projectiles comprising a plurality of abrasive media,
- positioning a metal part to treat against an upper end of the enclosure such that an outer surface of the metal part is facing an upper surface of a sonotrode of a vibration module,
- emission of a sinusoidal electrical signal according to a predetermined frequency, amplitude and duration by means of a generator of the vibration module,
- generation of vibrations of the sonotrode by means of a converter of the vibration module coupled to said sonotrode, said converter converting the electrical signal emitted by the generator into a mechanical vibration transmitted to the sonotrode for moving the projectiles which introduce residual compressive stresses and improve the surface condition of the metal part.

According to a third aspect, the invention relates to set of projectiles comprising a plurality of abrasive media, said set of projectiles being used in a shot blasting method for introducing residual compressive stresses in a metal part.

The invention and its different applications will be better understood on reading the description that follows and by examining the figures that accompany it.

BRIEF DESCRIPTION OF THE FIGURES

The figures are only presented for indicative purposes and in no way limit the invention.

The figures show.

DETAILED DESCRIPTION OF AT LEAST ONE EMBODIMENT OF THE INVENTION

Unless stated otherwise, a same element appearing in the different figures has a single reference.

The invention relates to a device 100 for treating a metal part 1 comprising an outer surface 1-1, the invention making it possible, in a single operation, to carry out both the compressive stressing (shot blasting) and the finishing of the metal part 1.

Figure 1:
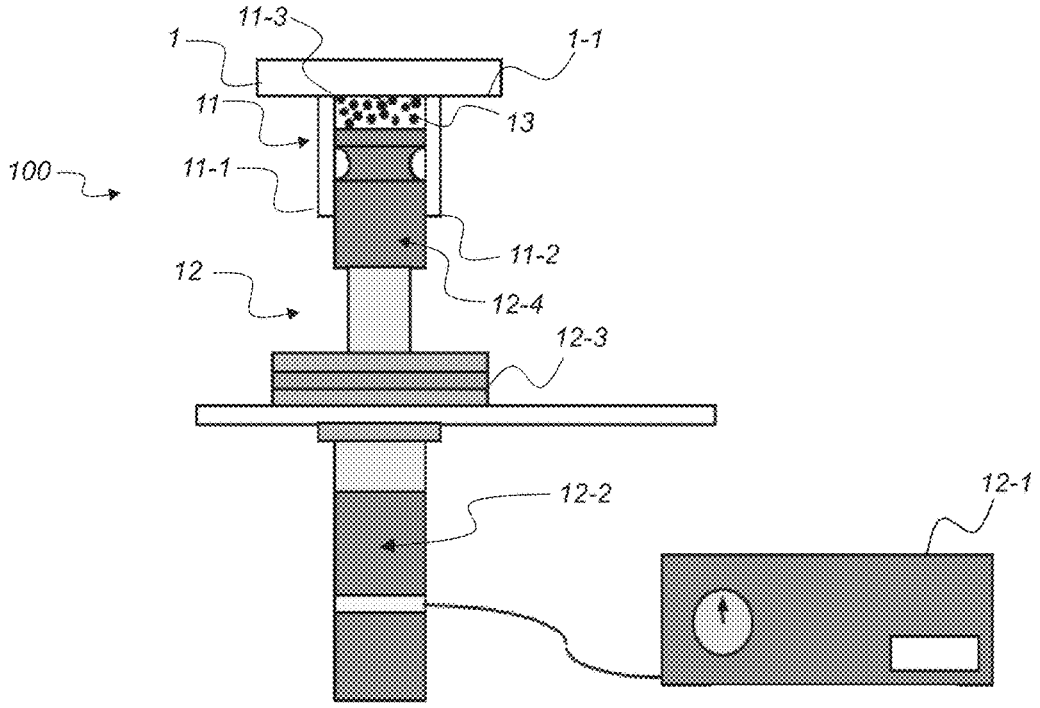
in FIG. 1, a diagram representing a device for treating a metal part according to a first embodiment of the invention, in FIG. 2, a diagram representing a device for treating a metal part according to a second embodiment of the invention, in FIG. 3, a diagram representing a device for treating a metal part according to a third embodiment of the invention, in FIG. 4, a diagram representing the steps of a method for treating the metal part according to an embodiment of the invention.

FIG. 1 represents the device 100 for treating a metal part 1 according to a first embodiment of the invention. With reference to FIG. 1, the device 100 comprises:

an enclosure 11,
a vibration module 12,
projectiles 13.

The enclosure 11 is intended to receive the abrasive medias 13 for treating the metal part 1. Thus, the enclosure 11 comprises a side wall 11-1 delimiting said enclosure 11. In addition, the side wall 11-1 has an open lower end 11-2 and open upper end 11-3. The metal part 1 is positioned against the upper end 11-3 of the enclosure 11 filling said upper end 11-3. It may be noted that the metal part 1 is maintained fixed to the upper end 11-3 of the enclosure 11 such that said metal part 1 does not risk being displaced during the treatment. Moreover, the vibration module 12 is positioned at the level of the lower end 11-2 of the enclosure 11 filling said lower end 11-2. Thus, when the metal part 1 and the vibration module 12 are positioned respectively at the level of the upper end 11-3 and the lower end 11-2, the enclosure 11 forms a closed enclosure such that the projectiles 13 cannot escape from said enclosure 11.

The vibration module 12 comprises:

a generator 12-1,
a converter 12-2,
a booster 12-3,
a sonotrode 12-4.

The generator 12-1 is intended to produce a sinusoidal electrical signal at ultrasonic frequency. According to a non-limiting embodiment, the ultrasonic frequency of the electrical signal is comprised in the interval [15 kHz, 60 kHz]. Moreover, according to a non-limiting embodiment, the amplitude of the sonotrode 12-4 is comprised in the interval [10 μm, 300 μm]. In addition, according to a non-limiting embodiment, the electrical signal is emitted for a duration ranging from several minutes to several hours. According to a non-limiting embodiment, the electrical signal 12-1 is emitted for a first duration d1 at a first frequency f1 and at a first amplitude A1 then, for a second duration d2 at a second frequency f2 and at a second amplitude A2.

The converter 12-2 is intended to convert the sinusoidal electrical signal at ultrasonic frequency emitted by the generator 12-1 into a mechanical wave. For example, the converter 12-2 is a piezoelectric transducer.

The booster 12-3 is intended to boost the amplitude of the mechanical wave generated by the piezoelectric transducer 12-2. The booster 12-3 is connected to the sonotrode 12-4 such that the amplified mechanical wave is transmitted to the sonotrode 12-4, which vibrates.

The sonotrode 12-4 is intended to move the projectiles 13 to project them against the outer surface 1-1 of the metal part 1. More specifically, the sonotrode 12-4 comprises a vibrating surface corresponding to the upper end of said sonotrode 12-4. The upper end of the sonotrode 12-4 forms the bottom of the enclosure 11 when the sonotrode 12-4 is at the level of the lower end 11-2 of the enclosure 11.

The projectiles 13 are intended to be projected against the outer surface 1-1 of the metal part 1. The projectiles 13 acquire their kinetic energy thanks to the vibrations of the sonotrode 12-4. The impact of the projectiles 13 against the outer surface 1-1 of the metal part 1 makes it possible to improve the surface condition and to induce residual compressive stresses in said metal part 1. To do so, the projectiles 13 comprise a plurality of abrasive media. The random movement of the projectiles 13 in the volume of the enclosure 11 ensures a uniform treatment of the zone of the metal part 1. According to a non-limiting embodiment, the projectiles 13 only comprise abrasive media.

Moreover, according to a non-limiting embodiment, each abrasive medium comprises a base and an abrasive charge. Thus, according to a non-limiting embodiment, at least one abrasive medium comprises a base made of plastic, ceramic, or instead an organic material. In addition, according to a non-limiting embodiment, the abrasive charge is chosen so as to be harder than the material of the metal part 1. To do so, the abrasive charge has a hardness comprised in the interval [8 Mohs, 10 Mohs]. The abrasive charge is constituted, for example, of corundum, alumina, boron nitride, silicon carbide, boron carbide, or diamond. Furthermore, at least one abrasive medium of the plurality of abrasive media has a cylindrical, spherical, pyramidal or conical shape. It may be noted that the thickness, the shape and the material of the abrasive media are chosen according to the characteristics of the metal part 1 to treat. Moreover, different types of abrasive media (shape, abrasive charge, base, thickness) may be used for the treatment of the metal part 1. Thus, for example, for zones with poor accessibility, abrasive media of low thickness will be preferred. Furthermore, according to another non-limiting embodiment, glass or instead ceramic beads are used jointly with the abrasive media to treat the metal part 1.

It may be noted that according to an embodiment not represented, the device 100 comprises at least two sonotrodes 12-4, each sonotrode 12-4 being equipped with an enclosure 11. Such a device 100 makes it possible to treat several metal parts 1 simultaneously using a single generator 12-1.

Figure 2:
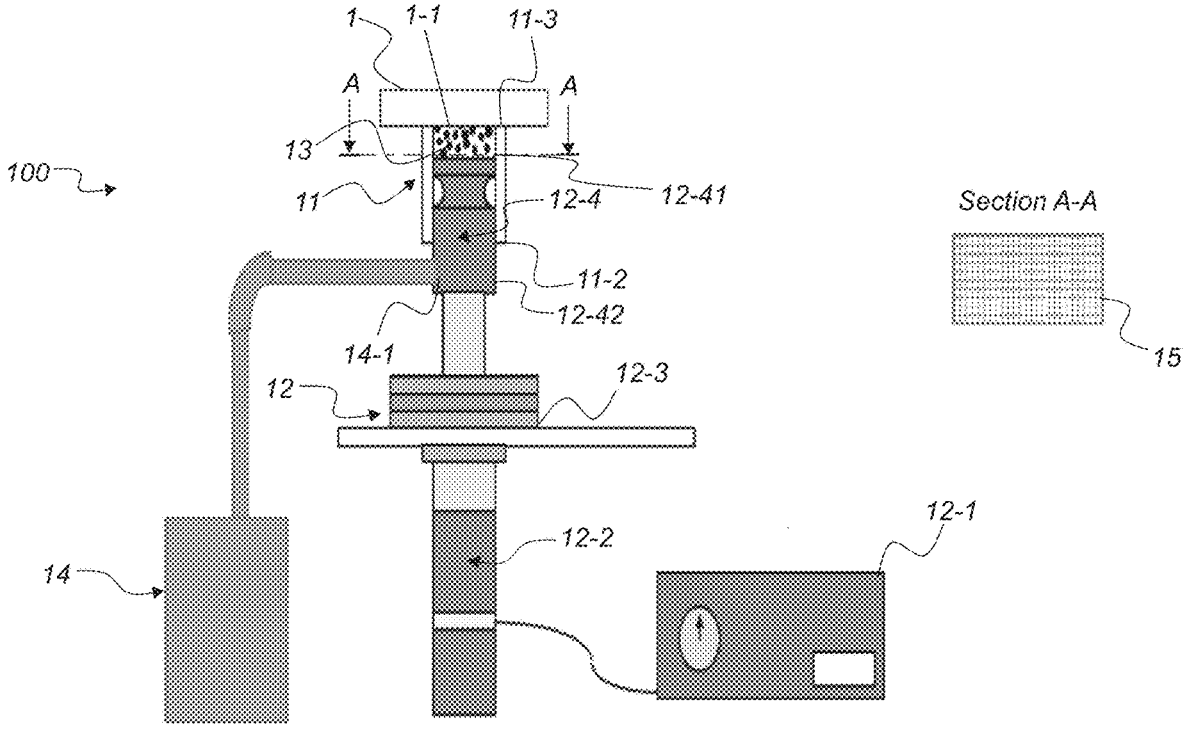

FIG. 2 represents the device 100 for treating a metal part 1 according to a second embodiment.

The device 100 according to the second embodiment comprises the same elements as the device 100 described in the first embodiment with reference to FIG. 1. In addition, unlike the device 100 of FIG. 1, the device 100 according to the second embodiment comprises a suction system 14 for sucking up residues of the metal part 1 and residues of projectiles 13 derived from the impact of the projectiles 13 with each other and of said projectiles 13 on the outer surface 1-1 of the metal part 1. Such a suction system 14 makes it possible to reduce the impact of the treatment on the material integrity of the metal parts 1 treated on account of residues capable of generating the circulation of projectiles 13 or being incrusted on the outer surface 1-1 of the metal part 1. Thus, according to the embodiment of FIG. 2, a head 14-1 of the suction system 14 is fixed on a lower part 12-42 of the sonotrode 12-4. In this embodiment, through apertures (not represented) are formed in the sonotrode 12-4 such that residues of the metal part 1 and residues of projectiles 13 derived from the impact of the projectiles 13 with each other and on the outer surface 1-1 pass through said apertures to reach the head 14-1 of the suction system 14 and thereby be sucked up by said suction system 14.

Moreover, a filter 15, visible in section A-A, is positioned in the enclosure 11 to allow only the passage of residues of the metal part 1 and residues of the projectiles 13 from the enclosure 11 to the suction system 14. Thus, still "whole" projectiles 13 are blocked by the filter 15 such that they are not sucked up by the suction system 14. In the embodiment shown in FIG. 2, the filter 15 is positioned on an upper surface 12-41 of the sonotrode 12-4 such that only residues of the metal part 1 and residues of projectiles 13 can pass through the apertures formed in the sonotrode 12-4. To do so, the size of the pores of the filter 15 is comprised in the interval [0.4 mm, 5 mm].

Figure 3:
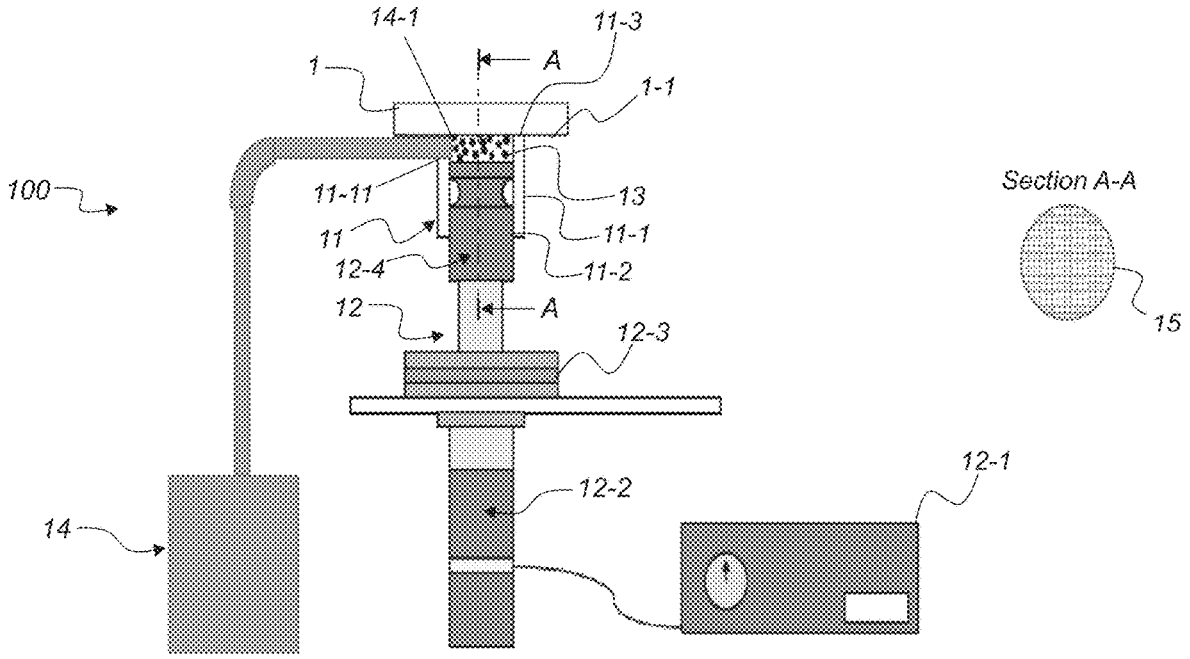

FIG. 3 represents the device 100 for treating a metal part 1 according to a third embodiment.

The device 100 according to the third embodiment comprises the same elements as the device 100 described in the second embodiment with reference to FIG. 2. In addition, unlike the device 100 of FIG. 2, the head 14-1 of the suction system 14 of the device 100 according to the third embodiment is fixed to an opening 11-11 formed in the side wall 11-1 of the enclosure 11. It may be noted that in this embodiment, the sonotrode 12-4 does not comprise through apertures. In addition, the filter 15, visible in section A-A of FIG. 3, is positioned at the level of the opening 11-11 formed in the side wall 11-1 of the enclosure 11, between the head 14-1 of the suction system 14 and the enclosure 11.

Furthermore, according to an embodiment not represented, a portion of the metal part 1 is protected by a protective element transferred onto said part 1 or onto the device 100 in order that said portion is not damaged by impacts of projectiles 13.

Figure 4:
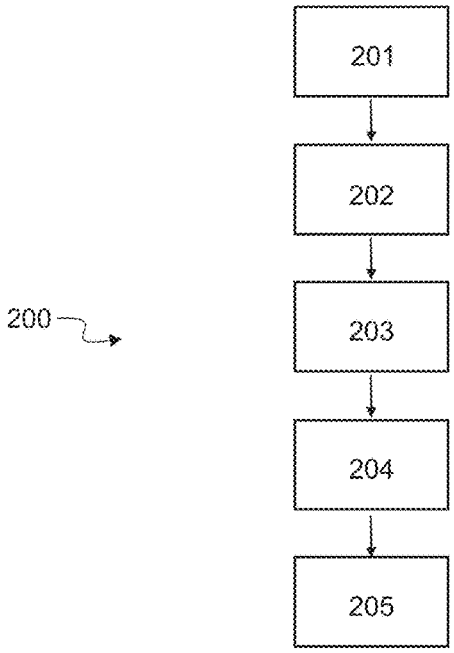

FIG. 4 represents the steps of a method 200 for treating a metal part 1 according to an embodiment of the invention. The method 200 is implemented by the device 100 for treating a metal part 1 described previously.

According to a first step 201, projectiles 13, comprising a plurality of abrasive media, are placed in the enclosure 11. It may be noted that the shapes(s) (cylindrical, pyramidal etc.), the material(s) and the size(s) of the abrasive media are chosen according to the material, the initial surface condition and the requirements as regards the metal part 1 to treat.

According to a second step 202, the metal part 1 is positioned against the upper end 11-3 of the enclosure 11 such that the outer surface 1-1 to treat of the metal part 1 is positioned facing the upper surface 12-41 of the sonotrode 12-4. The metal part 1 and the sonotrode 12-4 are positioned respectively against the upper end 11-3 and the lower end 11-1 of the enclosure 11. It may be noted that, according to a non-limiting embodiment, the metal part 1 is fixed on the upper end 11-3 of the enclosure 11 so as to prevent said metal part 1 from being displaced during the treatment under the impact of the projectiles 13.

According to a third step 203, the generator 12-1 emits a sinusoidal electrical signal at a predetermined frequency, amplitude and duration according to the characteristics of the metal part 1 to treat.

According to a fourth step 204, vibrations of the sonotrode 12-4 are generated by means of the converter 12-2 coupled to said sonotrode 12-4. It will be recalled that the converter 12-2 converts the electrical signal emitted by the generator 12-1 into a mechanical vibration which is transmitted to the sonotrode 12-4. The vibration of the sonotrode 12-4 ensures the movement of the projectiles 13 in the enclosure 11 which makes it possible to introduce residual compressive stresses and to improve the surface condition of the metal part 1.

The invention claimed is:

1. A device for treating a metal part having an outer surface, said device comprising:

an enclosure, a vibration module comprising:

a generator for generating an electrical signal at ultrasonic frequency, a converter for converting said electrical signal into a mechanical vibration, said mechanical vibration being transmitted to a sonotrode, the sonotrode positioned in said enclosure facing the outer surface of the metal part, projectiles placed in the enclosure for impacting the outer surface of the metal part, said projectiles being moved by the vibration of the sonotrode, wherein the projectiles comprise a plurality of abrasive media which, when moved by the vibration of the sonotrode, introduce residual compressive stresses and improve the surface condition of the metal part, and wherein the device further comprises a suction system sucking up residues of the metal part and residues of projectiles derived from the impact of said projectiles with each other and on the outer surface of the metal part and a filter only allowing the passage of residues of the metal part and residues of projectiles from the enclosure to the suction system.

2. The device for treating a metal part according to claim 1, wherein the abrasive media has a thickness comprised in the interval [0.8 mm, 10 mm].

3. The device for treating a metal part according to claim 1, wherein at least one abrasive medium of the plurality of abrasive media comprises a base made of one of the following materials:

plastic, ceramic, organic.

4. The device for treating a metal part according to claim 1, wherein at least one abrasive medium of the plurality of abrasive media comprises an abrasive charge having a hardness comprised in the interval [8 Mohs, 10 Mohs].

5. The device for treating a metal part according to claim 4, wherein the abrasive charge is constituted of at least one of the following compounds:

corundum, alumina, boron nitride, silicon carbide, boron carbide, diamond.

6. The device for treating a metal part according to claim 1, wherein at least one abrasive medium of the plurality of abrasive media has a shape among the following:

cylindrical, spherical, pyramidal, conical.

7. The device for treating a metal part according to claim 1, wherein the electrical signal is emitted at an ultrasonic frequency comprised in the interval [15 kHz, 60 kHz].

8. The device for treating a metal part according to claim 1, wherein an amplitude of the sonotrode is comprised in the interval [10 μm, 300 μm].

9. A method for treating a metal part, comprising:

placing projectiles in an enclosure, said projectiles comprising a plurality of abrasive media, positioning a metal part to treat against an upper end of the enclosure such that an outer surface of the metal part is facing an upper surface of a sonotrode of a vibration module, emitting a first sinusoidal electrical signal at a first frequency f1, first amplitude A1 and first duration d1 by means of a generator of the vibration module, emitting a second sinusoidal electrical signal at a second frequency f2, second amplitude A2, for a second duration d2 by means of the generator of the vibration module, generation of vibrations of the sonotrode by means of a converter of the vibration module coupled to said sonotrode, said converter converting the electrical signal emitted by the generator into a mechanical vibration transmitted to the sonotrode to move the projectiles which introduce residual compressive stresses and improve the surface condition of the metal part, sucking up, with a suction system, residues of the metal part and residues of projectiles derived from the impact of said projectiles with each other and on the outer surface of the metal part, and filtering, with a filter, to only allow the passage of residues of the metal part and residues of projectiles from the enclosure to the suction system.

* * * * *